US005308145A

United States Patent [19]

Koepke et al.

[11] Patent Number: 5,308,145

[45] Date of Patent: May 3, 1994

[54] RECLINING CHAIR

[75] Inventors: Marcus C. Koepke; Earl H. Koepke, both of Sturgis, Mich.

[73] Assignee: Kimball International Marketing, Inc., Jasper, Ind.

[21] Appl. No.: 836,071

[22] Filed: Feb. 12, 1992

[51] Int. Cl.[5] ..... A47C 1/032

[52] U.S. Cl. ..... 297/342; 297/316; 297/320

[58] Field of Search ..... 297/316, 323, 340, 342

[56] References Cited

U.S. PATENT DOCUMENTS 2,492,119 12/1949 Rowan ..... 297/342 X 2,494,779 1/1950 Prosser et al. ..... 297/342

2,509,739 5/1950 McDonald ..... 297/342 X 2,593,145 4/1952 Hoven et al. ..... 297/342

*Primary Examiner*—Peter R. Brown

*Attorney, Agent, or Firm*—Thomas J. Dodd

[57] ABSTRACT

A reclining chair which includes a pivotal connection between the seat support, the arm support and the back support. The connection allows for the seat support to be raised during reclining operation to allow a user to maintain a consistent eye level at all times. The pivotal connection includes links which are pivotally connected at the sides of the chair to their corresponding supports and are actuated by the weight of the user.

4 Claims, 4 Drawing Sheets

RECLINING CHAIR

FIELD OF THE INVENTION

This invention relates to chairs and has special application to chairs which have reclinable back supports.

BACKGROUND OF THE INVENTION

Chairs with reclining backs have been popular for more than one hundred years. Typical chairs of this type normally used a pivotal connection of the back support to an immovable part of the chair to allow for selective movement of the back support at an angle relative to the rest of the chair. In some cases, the pivotal connection was accomplished by the use of links and linkage systems as shown in the patents which accompany the enclosed information disclosure statement.

In each of the prior patents, a chair is disclosed with a reclinable back support which is connected by linkages to the chair base, arm supports, or seat supports. As the back support reclines, the vertical displacement between the top edge and the support surface lessens and the angle between the seat and back support gradually increases. This causes the vertical eye level of a user seated in the chair to be lowered which effectively changes the field of vision and often requires adjustments to be made to the surroundings.

Some of the prior art designers recognized the problems associated with eye level change and designed chairs whose seat supports also has mechanisms connected between the seat and the chair base. This allowed the user to selectively raise and lower the seat in response to eye level change caused by reclining the back support.

The prior art chairs identified above also did not address the mechanical balance of the chair to allow for the chair's tilt action tension to automatically adjust to all variations of a user's weight. Typically, when one of the prior chairs was shifted into the reclined position it was unbalanced until it reached its full reclined position or it was necessary to lock the chair in various tilting degrees. The unbalanced design of these chairs is annoying for users of different body weight especially in offices, vehicles, and theaters where chairs are used by so many different users daily.

SUMMARY OF THE INVENTION

The reclining chair of this invention includes a pivotal linkage which is interconnected between the arm support, the seat support and the back support. This interconnected linkage automatically raises the seat support in response to reclining the back support and lowers the seat support in response to the back support being returned to its upright position. In this manner, eye level of the user is maintained at a substantially constant vertical height without the necessity of a manual adjustment of the seat support.

The reclining chair of the invention also achieves a mechanical balance to allow for the chair's tilt action tension to automatically adjust to all variations of user weight. This is achieved by area specific locations and connections of the linkage system which respond to each individual user's weight as the force to overcome a vertical position into a reclined position because each person is utilizing the invented balanced chair mechanism to overcome their own specific weight the chair will recline with the same level of difficulty for all users (heavy and light in weight). This balance also allows all users to recline to any degree of rearward tilt and maintain that degree of tilt without the use of locking mechanisms.

Accordingly, it is an object of this invention to provide for a novel and improved chair which has a reclinable back support.

Another object is to provide for a reclining chair which automatically adjusts the vertical height of the seat support in response to back support movement to maintain the vertical eye level of the user.

Another object is to provide for a reclinable back chair which is operable by the user's weight.

Another object is to provide for a balanced reclining chair that may be shifted from an upright position to a reclined position and all degrees between with the same level of difficulty for different weight users.

Another object is to provide for a reclinable back chair which is economical, durable, and is easy to use and to maintain.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENTS

Figure 1:
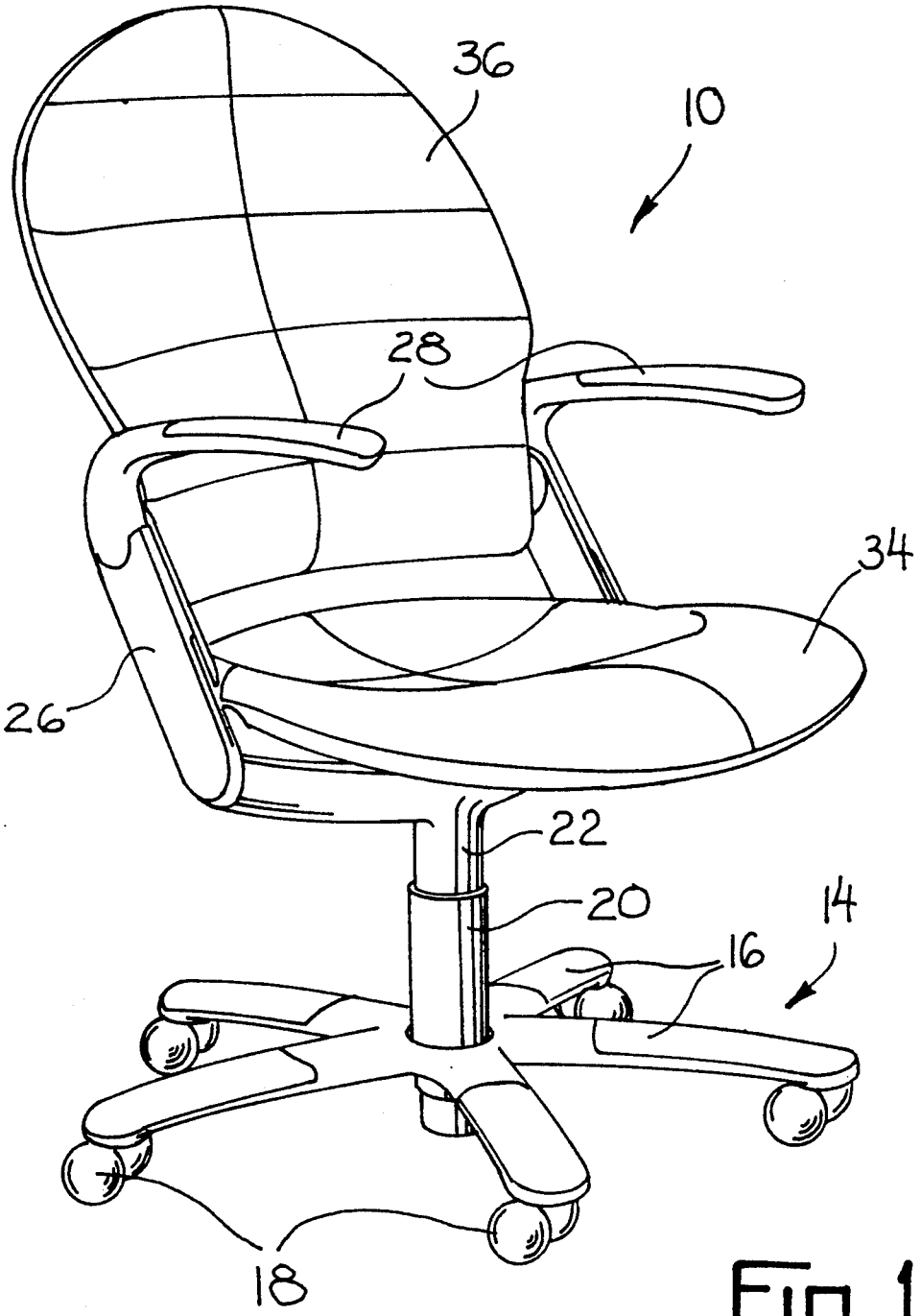
FIG. 1 is a perspective view of the reclining chair of this invention shown in an upright position.

The preferred embodiments herein described are not intended to be exhaustive or to limit the invention to the precise forms disclosed. They are chosen and described to explain the principles of the invention and their applications and uses to enable others skilled in the art to understand their teachings.

Referring now to the drawings, reference numeral 10 generally denotes the chair of this invention. A user 12 has been depicted in broken line form in FIGS. 2 and 3 to illustrate the operability of chair 10 and the success which is achieved in maintaining a constant vertical eye level, constant lumbar support, and user weight tilt resistance.

Chair 10 includes a base 14 which, in the embodiment shown is a conventional swivel type base found in an office chair or the like. It is understood that the principles of this invention may be applied in constructing a wide variety of chair designs, including, but not limited to office chairs, drafting chairs executive chairs, vehicle seats, plane seats and others. As shown, base 14 includes legs 16 which house casters 18, fixed tube 20 and adjustable T-support 22 which is telescopically fitted in tube 20 to allow for vertical adjustment of chair 10 in a common manner.

Chair supports 24 are fixedly connected to each end of T-support 22 by conventional means. Each chair support shown includes an upwardly extending portion 26 and an upper forwardly extending arm rest 28.

Chair 10 also includes a seat support 30 and back support 32. Supports 30 and 32 are conventional items found in all chairs and typically include a frame (not shown) covered by a cushion 34, 36 respectively. Support 30 and 32 are connected to chair supports 24 by a pivoting linkage system 38 to allow the supports 30, 32 to pivot between an upright or erect position (FIG. 2) and fully reclined position (FIG. 3).

Linkage 38 includes a first link 40 and a second link 42. Typically, there will be two sets of linkages 38, with each individual linkage connecting a side of each support 30, 32 to each chair support 24. For purposes of clarity only one such linkage system 38 will be described in detail here, with the understanding that both linkages function in substantially the same manner.

Figure 4:
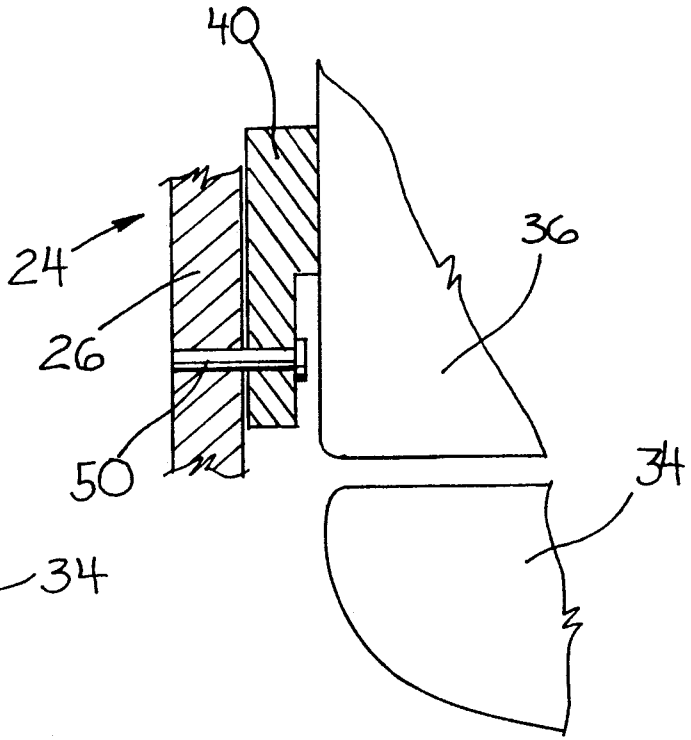
FIG. 4 is a sectional view taken along line 4—4 of FIG. 2.

Link 40 is normally the longer of the two links 40, 42 and has a first terminal end 46 and a second terminal end 48. As shown in FIG. 4, link 40 is fixedly connected to back support 32. Link 40 is operably connected between chair support 24 by pivot rod 50. Rod 50 has its terminal end fixed to chair support 24.

Figure 5:
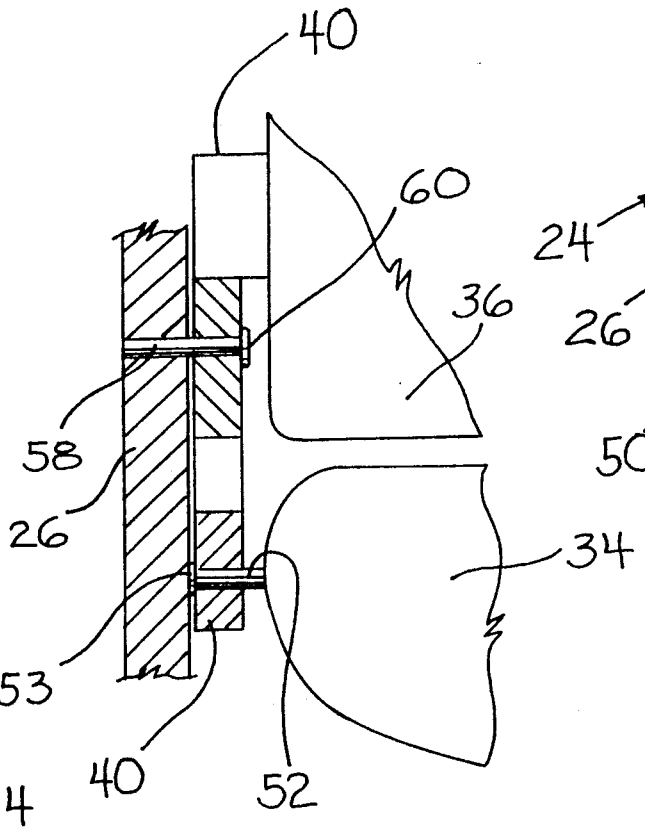
FIG. 5 is a sectional view taken along line 5—5 of FIG. 2.

As shown in FIG. 5, the lower end 48 of link 40 is operably secured to seat support 30 by pivot rod 52. Rod 52 extends freely through link 40 adjacent the link lower end 48 and has one end fixedly connected to seat support 30 with the other end terminating exteriorly of link 40 in an enlarged cap 53 to prevent the link 40 from disengaging from rod 52.

Link 42 is normally the shorter of the two links 40, 42 and has a first terminal end 54 and a second terminal end 56. As shown in FIG. 5 link 42 is operably connected to chair support 24 by pivot rod 58. Rod 58 freely extends through link 42 and is fixedly connected at one end to chair support 24. Rod 58 includes an enlarged cap 60 at its other end to prevent link 42 from slipping off the rod.

Figure 6:
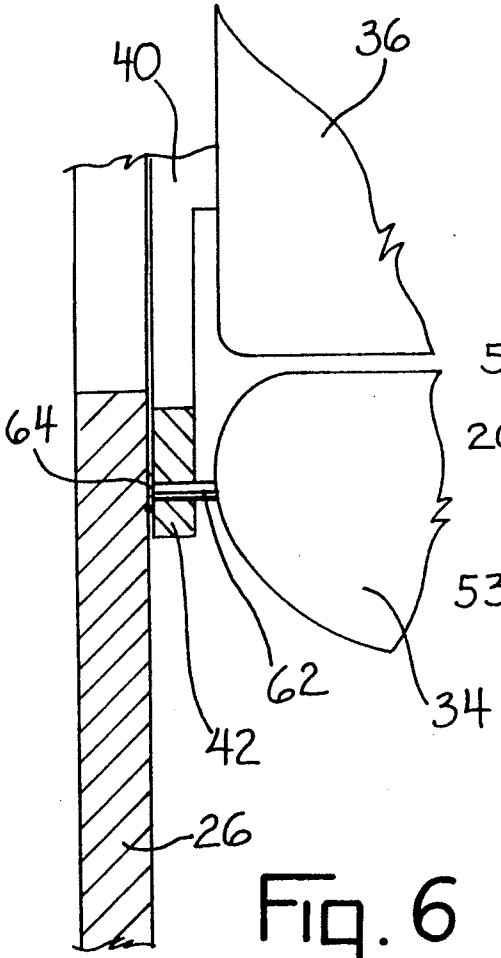
FIG. 6 is a sectional view taken along line 6—6 of FIG. 2.

As shown in FIG. 6, link 42 is operably connected to seat support 30 by pivot rod 62. Rod 62 extends freely through link 42 adjacent lower end 56 and terminates in an enlarged cap 64 which prevents link 42 from slipping off the rod. The other end of rod 62 is fixedly secured to seat support 30.

All of the rods 50, 52, 58, 62 are fixedly connected to their respective supports so as to remain stationary during seat and back support movement. Likewise, the fixed connection of chair supports 24 to chair base 14 prevents chair support movement relative to other chair parts.

Figure 2:
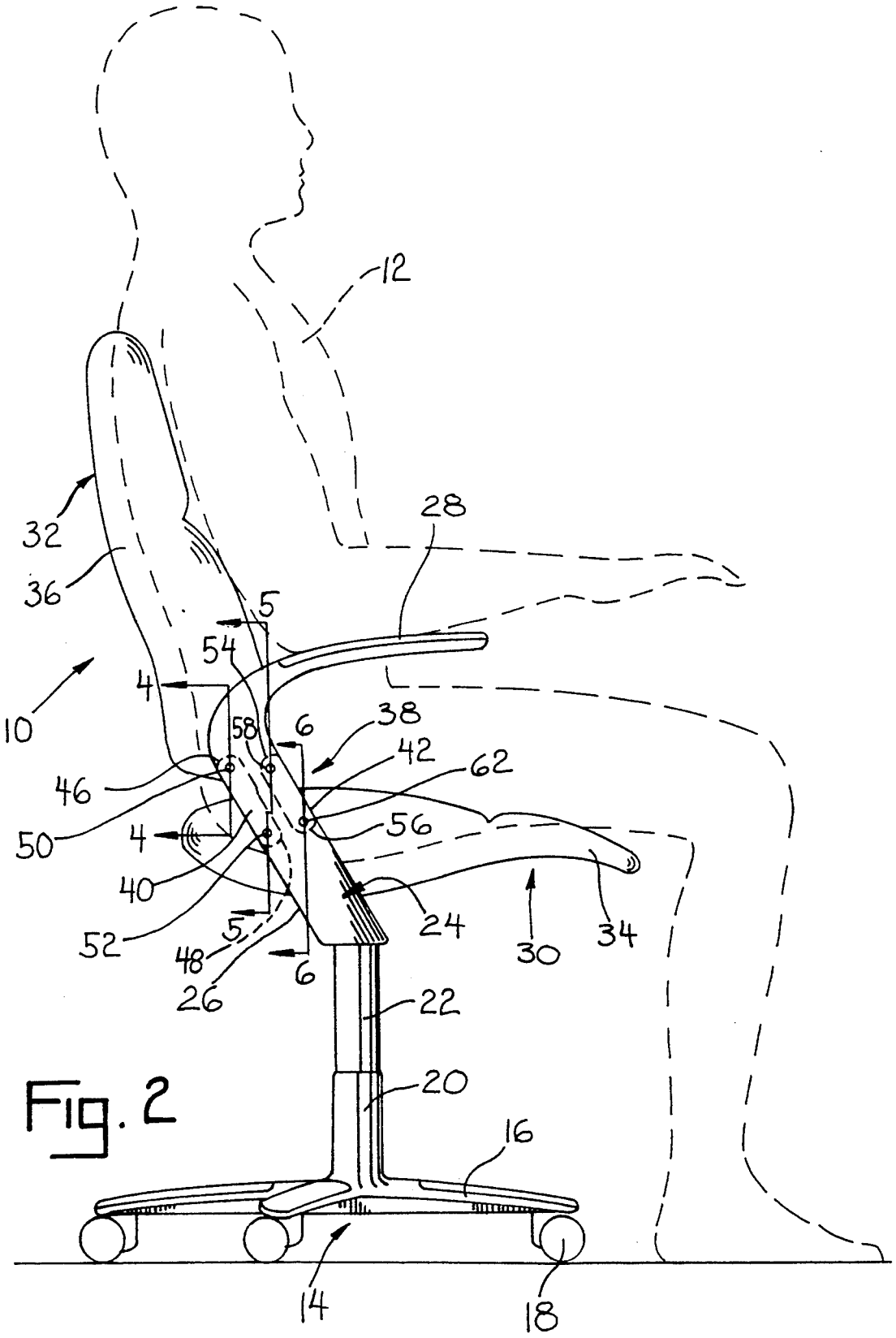
FIG. 2 is an elevation view of the chair of FIG. 1.
Figure 3:
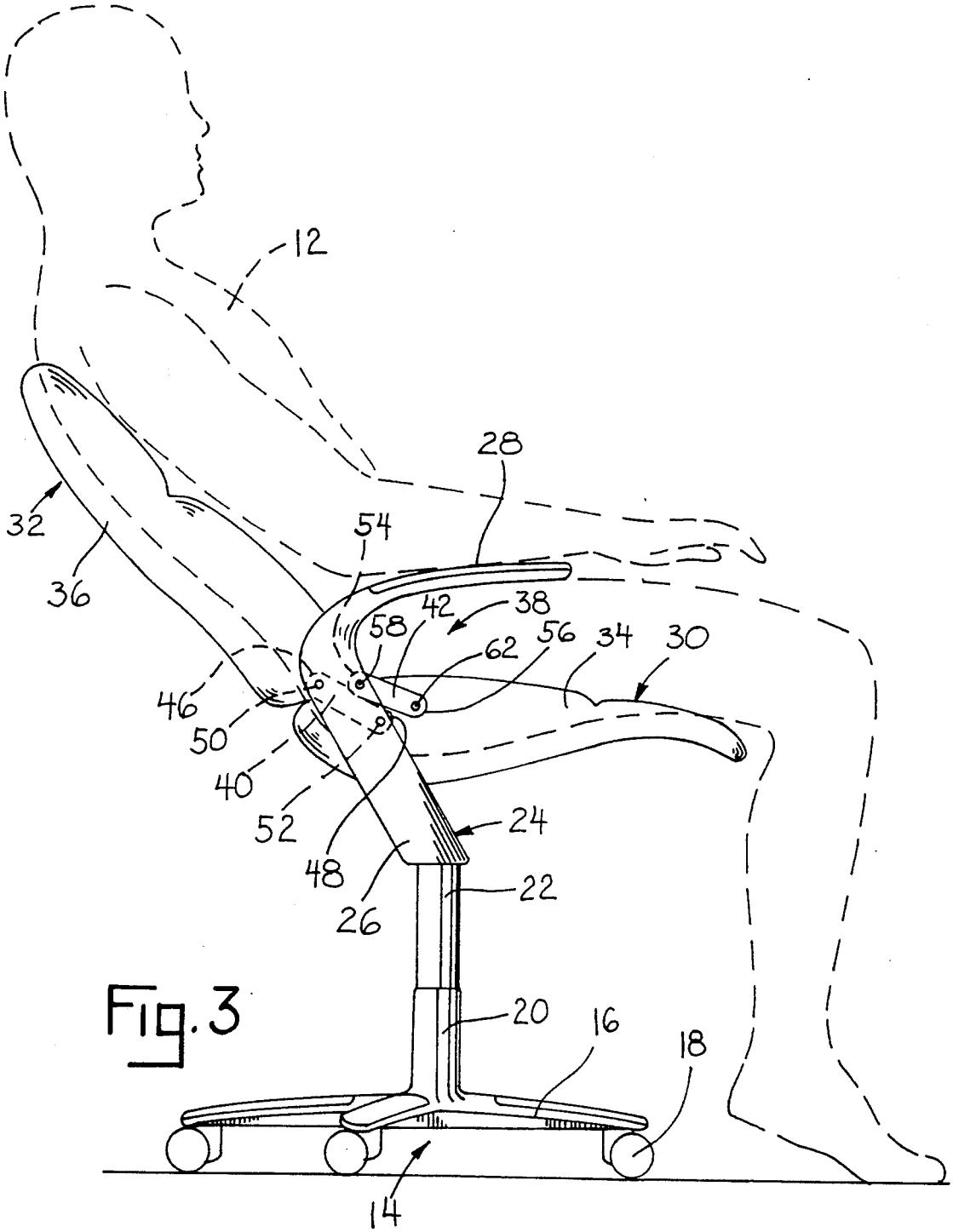
FIG. 3 is an elevation view of the chair in a reclined position.

FIGS. 2 and 3 illustrate the operability of chair 10 in its ability to recline back support 32 and correspondingly raise seat support 30. No external mechanisms are necessary to accomplish the reclining function since links 40, 42 function as load bearing members as well as performing the desired reclining function.

To effect reclining of the seat support 30 and back support 32, user 12 shifts his/her weight by leaning rearwardly from the hips. Such movement causes link 40 to pivot in a counterclockwise direction about rods 50, 52. Since link 40 is connected via rods 50, 52 to both seat support 30 and back support 32, this pivoting of link 40 causes the back support to recline and to simultaneously raise the seat support so the head of user 12 remains at about the same elevation.

During reclining operations, tilting link 42 also pivots counterclockwise about its rods 58, 62 to provide a controlled relationship between seat support 30 and back support 32 during reclining. Because rods 52 and 62 are fixedly connected to seat support 30, reclining of back support 32 also causes some forward movement of the seat support so that user 12 does not have to reposition his body to maintain proper support for the lumbar spinal area (FIG. 2).

To return the seat support 30 and back support 32 to the erect position to FIG. 1, user 12 simply leans forwardly from the hips. This cause clockwise rotation of links 40, 42 and corresponding movement of the seat and back supports into the erect or upright position.

Links 40, 42 also serve as stops to limit reclining movement to a safe inclination angle. As shown in FIG. 2, link 40 abuts against link 42 when a fully reclined position is reached.

It is understood that the above description does not limit the invention to the details given, but may be modified within the scope of the following claims.

We claim:

1. In a reclining chair including a base, peripheral arm supports fixedly connected to said base, a seat support, and a back support, means for pivotally connecting said seat support and back support to one of said arm supports wherein the back support is shiftable between a generally upright position and a reclined position, the improvement wherein said means for connecting comprises first and second links, said first link having a first end connected to said back support to and one of said arm supports, and a second end pivotally connected to said seat support, said second link having a first end pivotally connected to one of said arm supports, and a second end pivotally connected to said seat support and to one of said arm supports whereby said seat support is raised vertically upon shifting of the back support toward its reclined position to maintain vertical eye level of a user seated therein.

2. The reclining chair of claim 1 wherein said means for connecting further includes rods extending through said first and second links at the ends thereof, each link pivotable about said rods.

3. The reclining chair of claim 2 wherein said rods include a first rod extending from said back support through said first link first end and terminating in one of said arm supports, a second rod extending from said seat support through said first link second end and connected thereto.

4. The reclining chair of claim 3 and further including a third rod extending from said arm support through said second link first end and connected thereto, and a fourth rod extending from said seat support through said second link second end and terminating in said arm support.

* * * * *